US005336293A

United States Patent [19]

Freissmuth et al.

[11] Patent Number: 5,336,293

[45] Date of Patent: Aug. 9, 1994

[54] DESULFURIZING AGENT FOR PIG IRON AND CAST IRON, AND PROCESS FOR DESULFURIZATION

[75] Inventors: Alfred Freissmuth, Alpenblick 7, D-83355 Grabenstätt/Eristätt, Fed. Rep. of Germany; Eugen Wieser, Am Spitz, Austria

[73] Assignee: Alfred Freissmuth, Grabenstatt, Fed. Rep. of Germany

[21] Appl. No.: 105,751

[22] Filed: Aug. 12, 1993

[30] Foreign Application Priority Data

Aug. 13, 1992 [DE] Fed. Rep. of Germany ..... 4226833

[51] Int. Cl.[5] ..... C21C 7/00; C21C 7/02

[52] U.S. Cl. ..... 75/303; 75/315

[58] Field of Search ..... 75/315, 303

[56] References Cited

U.S. PATENT DOCUMENTS 3,929,464 12/1975 Todd ..... 75/536

3,998,625 12/1976 Koros ..... 75/536

*Primary Examiner*—Peter D. Rosenberg

*Attorney, Agent, or Firm*—Kenneth P. Glynn; Diane L. Ferrone

[57] ABSTRACT

The present invention describes an agent for the desulfurization of pig iron or cast iron, based on finely granulated magnesium and at least 3 w. % of an metallurgically silicious mineral with a bond, blend or crystal structure and/or one of the minerals syenite and/or rhyolite pure or as a mixture.

The desulfurizing agent may contain as an additional compound calciumcarbide and/or calciumoxide. The magnesium granule may be coated with these components.

This agent is preferrably fed to the iron melt either as a mixture or in the co-injection process as one compound through a lance where mixing is achieved with the second compound before entering into the iron melt.

21 Claims, No Drawings

DESULFURIZING AGENT FOR PIG IRON AND CAST IRON, AND PROCESS FOR DESULFURIZATION

BACKGROUND OF THE INVENTION

1. Field of the Invention

The present invention relates to an agent and a process for the desulfurizing of pig iron and cast iron.

2. Information Disclosure Statement

The desulfurization of iron melts by using magnesium as a highly effective agent has become standard practice in the steel industry. Because of the violent reaction of the magnesium in the iron melt, it cannot be applied alone; it requires blending to reduce the strong agitation or mixtures of magnesium. For these blends, lime, fluorspar and slag residue from the aluminum smelting process has been used, as well as calcium carbide, etc. These finely granulated blends are injected through a lance into the melt.

Pneumatic feeding of these mixtures caused in general a problem of discontinuous and pulsating feeding of the agent, leading to an increase of agent used per unit. To overcome this it was proposed to coat the magnesium granule to achieve an improved fluidity of the mixture. But these coatings introduced usually unwanted additional slag components.

According to another proposal, magnesium is included in a hollow wire, which then is shot into the melt. Because of the high costs, this system is used only in special cases and small ladles.

Finally the segregation of the magnesium in the mixture causes another problem during the transportation or during handling. This leads to zones rich and poor in magnesium. Such blends lead to inconsistent and not forseeable final sulfurs in the treated melts. Further, it was proposed to use the same coating for magnesium and the dilutant. But such a procedure is expensive and therefore not accepted. These systems lead to dissolution of magnesium in the iron melt.

Another route is the so called co-injection, in which magnesium is injected with one dispenser and the diluting components with a second dispenser, both feed-streams mix in the lance; a certain ratio between both components is maintained. But this equipment is very complicated and expensive; it requires costly instrumentation. Also, these systems lead to a solution of magnesium with rather limited desulfurization. To overcome this, a sequential injection has been proposed, i.e. carbide and magnesium is injected in alternate cycles. At the end of the treatment, the dissolved magnesium is blown out from the melt with calcium carbide. Also, this system needs a highly instrumented plant.

Magnesium exhibits a post-desulfurizing property, after the injection has been finished further Mg-sulfides are precipitated; the stable final sulfur is achieved relatively late and incomplete.

All these processes lead to an unavoided loss of iron. Up to 3% of the melt weight is included in the dry or pasty slag. Fluorspar may improve this phenomenon, but because of environmental reasons, it is not accepted in general.

There was a demand for a desulfurizer for iron melts which avoids these drawbacks completely or at least to a great extent and one that is available at a favorable price. Above this was a permanent demand to use a dilutant which not only works as such but also contributes to the desulfurizing process.

It is therefore an object of this invention to provide an improved agent for the desulfurization of iron melts, which avoids the drawbacks of the state of the art.

SUMMARY OF THE INVENTION

The present invention describes an agent for the desulfurization of iron melts based on magnesium wherein the final granulated magnesium contains at least 3 w. % of a metallurgically active silicious mineral with a bond, blend or crystal structure and/or one of the minerals syenite and/or rhyolite pure or as a mixture.

The desulfurizing agent may contain as an additional compound calcium carbide and/or calcium oxide. The magnesium granule may be coated with these components.

This agent is preferably fed to the iron melt either as a mixture of in the co-injection process as one compound through a lance where mixing is achieved with the second compound before entering into the iron melt.

DETAILED DESCRIPTION OF THE INVENTION

The agent descibed in this invention contains, besides the granulated magnesium, at least one natural silicious mineral. The content of such a mineral varies between 3 and 95%, preferrably 10–60 weight %. These minerals also exhibit the following features:

- liquid at the temperature of iron melts, respectively, and spontaneously by liquifying at a high speed at these temperatures,
- participate in the desulfurizing process because of their content of sodium, potassium.
- coating the magnesium when crushed to an appropriate size and thus exhibiting the same flow performance as the minerals alone,
- act as a desulfurizer because of the chemical composition and development of gases, which improve the mixing.

Such silicious minerals are freely available, like montmorillonite, perlite, kaolinite or those of the feldspar-group like albite as a Na-feldspar, K-feldspar or anorthite or syenite or rhyolithe with inclusions of plagioclase and biotite as well as nepheline, and sodium-aluminum-silicates.

In a basic version, the desulfurizing agent consists of a blend of magnesium, silicious mineral and, if necessary, calcium carbide and/or calcium oxide.

In another realization of the invention, the magnesium granules are coated with these silicious minerals and other components. This is done by the usual mixing process, whereas the silicious minerals are crushed down to a similar size as magnesium, thus shaping a shell around the magnesium granule.

In this shell, other components like calcium carbide or lime may be incorporated.

Such a desulfurizing agent consists of:

- 5 to 92 w. % magnesium,
- 3 to 90 w. % feldspar, nepheline-syenite or rhyolite or montmorillonite,
- 5 to 92 w. % calcium carbide and/or calcium oxide.

This coating, produced if necessary with standard water-free binders, results in a uniform fluidity like the mineral-constituent. By this method, an agent is produced which can be uniformly injected during the entire injection period in the pre-determined amount.

Further on, by this coating magnesium loses the metallic surface, thus reducing the tendency for it to segregate during transport and handling. These desulfurizing blends can be easily injected by using the simple monoinjection-technology; the co-injection technology is not necessary.

The silicates contribute to the desulfurizing reaction because of their content of alkalis, like nepheline and sodium; feldspar and potassium. These minerals split off the alkali and form alkali sulfides separating into the slag. At the same time, these minerals cause a liquification of the slag, thus reducing the tendency to hold iron granules.

The chemical and physical properties of certain silicious minerals like rhyolite/perlite, cause an expansion and foaming at the termperature of the iron melt. The good wettability of these fused minerals causes a slow rise in the melt, collecting the sulfur-containing components, and thus eliminating the post desulfurizing-behavior for magnesium. The final sulfur does not change.

These silicates provide a strong effect on the slag properties. The use of these silicates leads, surprisingly, to a reduction of the iron content in the slag which is considerably lower than that in standard desulfurizing blends. A reduced iron content in the slag results in an improved iron-yield, improving the economy of the entire process. At the same time this slag can be easily and completely raked off with standard equipment.

The silicates of the present invention changed the performance of the diluting material in the blend in so far as they liquify them or at least transfer them in a viscous constitution, thus improving the acceptance of sulfidic products and improving their separation performance.

In a prefered version, the agent contains together with magnesium as a desulfurizing compound, 3 to 96 w. % feldspar or nepheline-syenite, further 5 to 50 w. % rhyolite montmorillonite.

In general, a desulfurizing agent according to the present invention does not need the addition of a fluidizing aid but should it be necessary, e.g. because of the characteristics of the injection plant, these additives do not exhibit a detrimental effect.

The present invention will be described in further detail with reference to the following examples.

EXAMPLE 1

A mixture of 50 w. % magnesium, grain size 0.2 to 0.9 mm, and 50 w. % sodium-feldspar of a similar size was injected into a 170 t pig iron melt through an injection lance.

The average value of eleven melts yielded an initial sulfur content of 0.046 w. % and a final sulfur content of 0.006 w. %. The amount of mixture per ton of pig iron was 1.08 kg. This means a magnesium consumption of 0.54 kg magnesium. The raking of the slag was easy, the content of iron granules was only 16 w. %.

EXAMPLE 2

A mixture consisting of 25 w. % granulated magnesium, 45 w. % calcium carbide and 30 w. % perlite was used.

Nine treatments with an average weight of 115 tons showed an average initial sulfur content of 0.038 w. % and, after treatment, an average content of 0.004 w. %. The injected amount was 1.46 kg agent per ton corresponding to a magnesium consumption of 0.36 kg/t. The injection time was approximately 7 minutes.

All melts treated with this agent contained low iron contents as granules, in the range of 10 to 20 w. %. The slag was easily raked off without pulling off liquid iron.

EXAMPLE 3

The mixture consited of 25 w. % magnesium 45 w. % calcium oxide and 30 w. % sodium-feldspar; nine melts each of approx. 115 tons were treated.

The average starting sulfur was approximately 0.040 w. %; the final sulfur after the treatment was less than 0.005 w. %. 1.55 kg agent/ton iron was injected, resulting in a magnesium consumption of 0.39 kg/ton. Injection time was about 7 minutes. The slag contained iron granules between 10 to 20 w. %. The slag was easily raked off without pulling off the iron melt.

EXAMPLE 4

In a series of tests the efficiency of the agent according to the present invention was tested with the co-injection technology. This work was done with the submarine ladle holding approximately 200 tons iron melt. The granulated magnesium (0.2 to 0.9 mm) was blended with 20 w. % perlite; the second compound contained calcium carbide and 40 w. % sodium-/feldspar. The ratio between both co-injection compounds was 1:3.5 in favor of the calcium carbide blend. To reduce the starting sulfur from 0.040 w. % to 0.005 w. % final sulfur content, the consumption of magnesium was 0.35 kg/ton compared with 0.47 kg/ton when working with standard mixtures. The content on iron granules was found to be less than 15 w. %. The flow of the slag from the submarine ladle was good even after holding the ladle over a long period after the treatment.

What is claimed is:

1. A magnesium based desulfurization agent for the desulfurization or iron melts comprising:

a) granulated magnesium; and, b) at least 3 percent by weight of at least one metallurgically active silicious mineral, said silicious mineral of about the same grain size as said granulated magnesium.

2. The desulfurization agent of claim 1 further including:

c) a mineral chosen from the group consisting of rhyolite, syenite, and combinations thereof.

3. The agent of claim 1 wherein said silicious mineral is present at a level of 3% to 95% by weight and said silicious mineral is chosen from the group consisting of feldspar and nepheline-syenite.

4. The agent of claim 1 wherein said silicious mineral is present at a level of 5% to 50% by weight and said silicious mineral is a mineral chosen from the group consisting of rhyolite, montmorillonite and combinations thereof.

5. The desulfurizing agent of claim 1 wherein a coating surrounds said granulated magnesium, said coating comprised of said silicious mineral.

6. The desulfurizing agent of claim 3 wherein a coating surrounds said granulated magnesium, said coating comprised of said silicious mineral.

7. The desulfurizing agent of claim 4 wherein a coating surrounds said granulated magnesium, said coating comprised of said silicious mineral.

8. The desulfurizing agent of claim 5 wherein said coating further contains a compound selected from the group consisting of calcium carbide, calcium oxide and combinations thereof.

9. The desulfurizing agent of claim 6 wherein said coating further contains a compound selected from the group consisting of calcium carbide, calcium oxide and combinations thereof.

10. The desulfurizing agent of claim 7 wherein said coating further contains a compound selected from the group consisting of calcium carbide, calcium oxide and combinations thereof.

11. The desulfurizing agent of claim 8 wherein said coating consists of 3 to 90% by weight said silicious mineral and 5 to 92% by weight of a compound selected from the group consisting of calcium carbide, calcium oxide and combinations thereof.

12. The desulfurizing agent of claim 9 wherein said coating consists of 3 to 90% by weight said silicious mineral and 5 to 92% by weight of a compound selected from the group consisting of calcium carbide, calcium oxide and combinations thereof.

13. The desulfurizing agent of claim 10 wherein said coating consists of 3 to 90% by weight said silicious mineral and 5 to 92% by weight of a compound selected from the group consisting of calcium carbide, calcium oxide and combinations thereof.

14. A process for the desulfurization of an iron melt using a desulfurizing agent comprising:

a) granulated magnesium; and, b) at least 3 percent by weight of at least one metallurgically active silicious mineral, said silicious mineral of about the same grain size as said granulated magnesium;

wherein said desulfurizing agent is fed into said iron melt by means of an injection lance.

15. The process of claim 14 wherein said desulfurizing agent is added in a co-injection process as one component to a second component chosen from the group consisting of calcium carbide, calcium oxide and combinations thereof.

16. The process of claim 14 wherein said magnesium is fluidized separately as a co-injection compound and is mixed in said lance with said silicious mineral.

17. The process of claim 15 wherein said magnesium is fluidized separately as a co-injection compound and is mixed in said lance with said silicious mineral and said second component.

18. The process of claim 14 wherein said silicious mineral is present at a level of 3% to 95% and said silicious mineral is chosen from the group consisting of feldspar and nepheline-syenite.

19. The agent of claim 14 wherein said silicious mineral is present at a level of 5% to 50% by weight and said silicious mineral is chosen from the group consisting of rhyolite, montmorillonite and combinations thereof.

20. The process of claim 14 wherein a coating surrounds said magnesium and said coating is comprised of said silicious mineral.

21. The process of claim 20 wherein said coating further includes a component selected from the group consisting of calcium carbide, calcium oxide and combinations thereof.

* * * * *